US005736811A

United States Patent [19]

Westemeyer et al.

[11] Patent Number: 5,736,811

[45] Date of Patent: Apr. 7, 1998

[54] CAPPED HIGH-PRESSURE DISCHARGE LAMP

[75] Inventors: Manfred Westemeyer, Aldenhoven; Ralf Schäfer, Aachen, both of Germany; Leonardus U.E. Konings, Eindhoven, Netherlands

[73] Assignee: U.S. Philips Corporation, New York, N.Y.

[21] Appl. No.: 522,646

[22] Filed: Sep. 5, 1995

Related U.S. Application Data

[63] Continuation of Ser. No. 58,607, May 6, 1993, abandoned.

[30] Foreign Application Priority Data

May 11, 1992 [EP] European Pat. Off. ..... 92201333

[51] Int. Cl.[6] ..... H01J 5/48

[52] U.S. Cl. ..... 313/318.02; 313/623; 313/634; 313/331; 439/611

[58] Field of Search ..... 313/318.02, 51, 313/624, 623, 567, 634, 331; 439/602, 611

[56] References Cited

U.S. PATENT DOCUMENTS

| | | | |
|---|---|---|---|
| 4,823,049 | 4/1989 | Sanders et al. | 313/318 X |
| 4,935,668 | 6/1990 | Hansler et al. | 313/634 X |
| 5,216,319 | 6/1993 | Van Heeswijck | 313/318 |

FOREIGN PATENT DOCUMENTS

| | | | |
|---|---|---|---|
| 0321867 | 6/1989 | European Pat. Off. . | |
| 0374846 | 6/1990 | European Pat. Off. . | |
| 3743612 | 7/1989 | Germany . | |
| 4112911 | 11/1991 | Germany . | |
| 3233853 | 10/1991 | Japan . | |
| 0041198 | 2/1993 | Japan | 313/634 |
| 9101280 | 2/1992 | Netherlands . | |

*Primary Examiner*—Ashok Patel
*Attorney, Agent, or Firm*—Walter M. Egbert, III

[57] ABSTRACT

The capped high pressure discharge lamp includes a light source (1) having a lamp vessel (1') with a first neck shaped portion (2) to which a lamp cap (30) is fixed. A connection conductor (7) runs alongside the discharge vessel to connect a second current supply conductor (5) extending from a second neck shaped portion (3) to a second contact member (36) of the cap. The lamp vessel (1') is contained by a tubular outer envelope (20), which is filled with air and does not envelope the connection conductor (7). The outer envelope (20, 50) has a narrowing portion (21, 52, 51) which encloses the second current supply conductor (5) or a neck shaped portion (2, 3). The outer envelope is maintained. The lamp is of a simple construction which allows for optimizing the light output or the temperature of the lamp vessel.

13 Claims, 1 Drawing Sheet

CAPPED HIGH-PRESSURE DISCHARGE LAMP

This application is a Continuation of U.S. Patent application, Ser. No. 08/058,607, filed May 6, 1993, now abandoned.

The invention relates to a capped electric lamp comprising:

a light source having a lamp vessel which is closed in a gastight manner and which has an ionizable filling, and is provided with a first and a second mutually opposed neck-shaped portion, each having a seal, through which neck-shaped portions a first and a second current supply conductor, respectively, extend to a pair of electrodes arranged in the lamp vessel;

a lamp cap of insulating material to which the lamp vessel is fixed with its first neck-shaped potion, which lamp cap has a first contact member connected to the first current supply conductor, and a second contact member;

a connection conductor which runs alongside the lamp vessel to the lamp cap and is connected to the second current supply conductor and the second contact member; and the lamp vessel having a substantially concentric tubular outer envelope which is filled with air.

BACKGROUND OF THE INVENTION

Such a capped high-pressure discharge lamp is known from German patent reference DE 41 12 911.

In the known lamp, the outer envelope is a glass dome which is placed over the lamp vessel and over the connection conductor and is fastened to the lamp cap. High requirements are imposed on the fastening because of the dimensions of the envelope, its width and its length, and the high temperature during lamp operation. Since the lamp cap of the lamp is made of synthetic resin, the outer envelope is first fastened separately to a ceramic body by means of an organic cement. The latter in fact has a high thermal resistance, but also requires a high temperature for curing. The ceramic body is subsequently united to the synthetic-resin portion of the lamp cap.

To prevent lamp life being shortened by the presence of the outer envelope, several vent openings are present in the lamp cap. The outer envelope is in open connection with the surroundings through these openings, and a convection flow takes place which cools the lamp vessel.

The known lamp is comparatively heavy, which has consequences for its impact and vibration resistance, and has a comparatively complicated construction. The lamp may be used as a vehicle headlamp.

A similar lamp is known from The Netherlands patent reference 91 01 280 A. An opening is present in the lamp cap also in this case, so that the outer envelope is in open connection with the surroundings. The outer envelope has a rim around which a synthetic-resin ring grips, the ring being ultrasonically connected to the synthetic-resin lamp cap. This involves risks because reference studs are present close to the welding spot, which studs are to position the lamp accurately during insertion in a vehicle headlamp and which accordingly must not be deformed or shifted.

German patent reference 37 43 612 A1 discloses a high-pressure discharge lamp as a vehicle headlamp in which an evacuated outer envelope encloses the lamp vessel in vacuum tight manner. The manufacture of pinch seals in this envelope increases the cost and price of the lamp considerably. The overall length of the lamp is also increased, partly because a provision must be present in the outer envelope for accommodating differences in linear thermal expansion between glass parts and metal parts.

Sealed-beam high-pressure discharge lamps functioning as vehicle headlamps are known from European patent reference 0 374 846 A2 and from U.S. Pat. No. 4,935,668, mounted axially and axially or transversely, respectively, in a closed reflector. The lamp vessel is surrounded by a jacket which is closed in vacuum tight manner.

A high-pressure discharge lamp with an outer envelope which is closed in a vacuum tight manner, while current conductors from which the enveloped lamp vessel is suspended issue to the exterior from a lamp cap, is known from Japanese patent reference 3-233,853 A.

SUMMARY OF THE INVENTION

It is an object of the invention to provide a capped high-pressure discharge lamp of the kind mentioned in the opening paragraph which is of a simple construction and which can be readily realised.

According to the invention, this object is achieved in that the connection conductor extends outside the outer envelope and the outer envelope is substantially cylindrical and has a narrowing portion which encloses the light source.

It is an attractive aspect of the capped high-pressure discharge lamp according to the invention that the outer envelope surrounds the lamp vessel without at the same time surrounding the connection conductor. The result of this is that the outer envelope can surround the lamp vessel with a clearance as desired, which clearance may be small to very small. It is advantageous that a slim outer envelope has a small mass and can accordingly be easily kept in position in the case of impacts and vibrations, and has a greater impact and vibration resistance. The mass of the outer envelope is small not only because this envelope is slim, but also because it is comparatively short. This is because the connection conductor is not enveloped, so that also the connection between the connection conductor and the second current supply conductor lies outside the envelope.

Another attractive aspect is that the outer envelope need not be closed with a domed end, but is merely narrowed. A constriction can be provided very easily and with high accuracy.

In a first embodiment, the narrowing portion encloses the second current supply conductor. The narrowing portion is then obtained, for example, in that a tube is locally heated and then pulled out, so that a constriction is created. The outer envelope of the lamp according to the invention need not have a vacuum tight seal around this second current supply conductor. The outer envelope accordingly may be manufactured separately from the lamp vessel. The second current supply conductor which enters the narrowing portion center the outer envelope and keeps it separated from the lamp vessel at its end remote from the lamp cap. The narrowing portion may enclose the second current supply conductor narrowly, but still provide space for thermal expansion thereof, so that detrimental stresses in the envelope can be prevented in the case of temperature rises.

Another attractive aspect of this embodiment is that the lamp need not or hardly needs to be formed differently compared with the situation without the presence of the outer envelope. The outer envelope, if so desired, may simply be added as a component to a lamp without this envelope.

The lamp vessel is electrically connected at its end remote from the lamp cap and is mechanically supported together with the outer envelope by the connection conductor. The connection conductor, which has a rigidity chosen as required, limits the displaceability of the outer envelope in its longitudinal direction by its connection to the second current supply conductor. This displaceability is limited in the opposite direction by the lamp cap. The lamp cap supports and thus positions the outer envelope directly, and indirectly through the interposition of the lamp vessel and the connection conductor.

In a favourable modification, the tolerance as to the length of the lamp vessel, the length of the outer envelope and the length of the connection conductor is increased. In this modification, nevertheless, the axial shifting possibility of the outer envelope is limited as required. In this modification, the second current supply conductor comprises an abutment for the outer envelope outside the outer envelope. A favourable and convenient abutment is one in the form of a metal sleeve which surrounds the conductor and on which the connection conductor is fastened to the second current supply conductor, for example, through welding.

Since the outer envelope in this embodiment is supported at both its ends, it is not necessary for this envelope to have a rigid fastening to the lamp cap. It suffices for the outer envelope to be surrounded by a lamp cap portion, for example an edge or a number of projections, or for the outer envelope to surround a lamp cap portion. A transverse and a longitudinal fixation of the outer envelope may be realised by these means.

Before the connection between the second current supply conductor and the connection conductor is made, the outer envelope may be provided around the lamp vessel in that it is passed over this vessel. Fixation then takes place in that the connection between the two conductors is effected, and possibly an abutment is provided.

To prevent rattling, it is favourable if the lamp cap and the outer envelope, and also the second current supply conductor and the outer envelope cooperate in a suitable manner. The outer envelope may in fact be almost closed because convection flow through the envelope is not necessary and may even be undesirable.

It may be advantageous, however, if only a small number of components is to be joined together during assembly of the capped high-pressure discharge lamp. In a favourable embodiment, the capped high-pressure discharge lamp according to the invention has an outer envelope with a narrowing portion which is coupled to a neck-shaped portion of the lamp vessel. During manufacture of this embodiment, a substantially cylindrical glass tube is passed around the lamp vessel and a portion of this tube is heated so that it is softened. The softened portion can then collapse or be forced toward the neck-shaped portion with tools so as to form the narrowing portion. A mechanical coupling with the lamp vessel is created in that way. It is not necessary for a vacuum tight joint to arise from that operation.

It is favourable if the outer envelope is coupled to the first neck-shaped portion, e.g. to an open substantially cylindrical tubular portion thereof, e.g. by urging or allowing the outer envelope to collapse onto the cylindrical tubular portion. The lamp cap may then bear on the outer envelope for fixing the lamp vessel, or on the lamp vessel, or on both. It is mechanically favourable if the lamp cap bears on the outer envelope, the latter having a greater diameter than the neck-shaped portion. Alternatively, the narrowing portion may couple the outer envelope to the second neck-shaped portion e.g. to an open substantially cylindrical tubular portion thereof. The outer envelope may then also be supported by the lamp cap, for example, as in the first embodiment.

An attractive modification has a narrowing portion for cooperating with each of the two neck-shaped portions. The light source and its outer envelope then form a very robust unit.

The second embodiment in its various modifications has the advantage that a good mechanical coupling can be achieved without, vacuum tight, fusions being made. During making of seals the lamp vessel would have had to be softened to a considerable extent locally. Deformations of the lamp vessel could have occurred then, which are in fact to be avoided. It is also advantageous that the outer envelope is allowed to be filled with air. Complicated manufacturing steps are avoided by this, which steps would be necessary if a different gas or vacuum were to be present in the outer envelope.

It was found to be favourable for a comparatively low maximum temperature of the lamp vessel if the outer envelope narrowly encloses the lamp vessel, for example, with a clearance on all sides of approximately 0.1 mm or a fraction thereof. Alternatively, the outer envelope may have a clearance of several tenths of a mm up to several ram, for example, 6 mm. A clearance up to approximately 2 mm is favourable, and in particular up to approximately 1.5 mm. It was found that the lumen output of the lamp can then be higher than without an envelope or with a ventilated envelope. Such an increase in the lumen output may be favourable, for example, if factors other than the maximum temperature of the lamp vessel determine the length of lamp life.

It is an advantage of the substantially cylindrical, tubular outer envelope, that the envelope need not be shaped prior to the coupling to the lamp vessel. The small clearance from the widest portion of the lamp vessel, the portion enclosing the discharge space, implies that the outer envelope needs to bridge a small distance only, when becoming coupled to the lamp vessel.

The outer envelope may be made of, for example, quartz glass or some other glass with a high melting temperature, for example, glass with an $SiO_2$ content of 95% by weight or more. The envelope may be selectively radiation-transmitting or comprise a coating with such a property, for example, UV-absorbing, IR-reflecting, or transmitting to coloured light.

The high-pressure discharge lamp according to the invention may have an ionizable filling of rare gas such as, for example, xenon, argon, or mixtures of rare gases, for example, with a pressure of a few mbar up to a few bar at room temperature. The filling may in addition comprise mercury and/or metal halide. The lamp may be used as a vehicle headlamp but it is also suitable for other applications, for example, in a position other than a horizontal position, particularly coaxially in an optical system, e.g. a reflector.

The lamp cap may consist of, for example, a synthetic resin, for example, a thermoplastic synthetic resin such as a resin chosen from among polyether imide, polyether sulphon, polyphenylene sulphide, polyether ketone, polypropylene oxide, polyamide imide, polyimide, polybutylene terephthalate, which may be charged with powdery or fibrous substances such as, for example, chalk or glass.

BRIEF DESCRIPTION OF THE DRAWINGS

Embodiments of the capped high-pressure discharge lamp according to the invention are shown in the drawing, in which.

DESCRIPTION OF THE INVENTION

Figure 1:
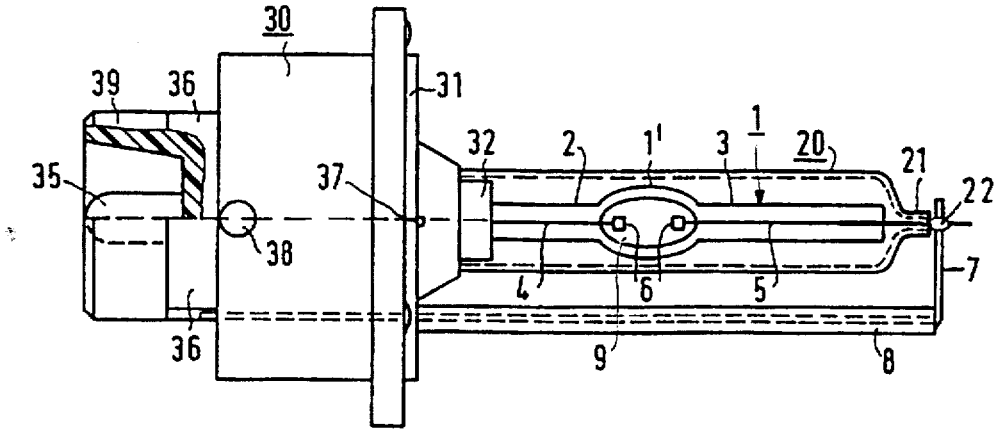
FIG. 1 shows a first embodiment in side elevation, partly broken away.

In FIG. 1, the capped high-pressure discharge lamp comprises a light source 1 with a gaslight closed lamp vessel 1' containing an ionizable filling gas and a first 2 and a second 3 mutually opposed neck-shaped portion, each with a seal, a first 4 and a second 5 current supply conductor running through these respective seals to a pair of electrodes 6 arranged in a discharge space 9 of the lamp vessel. The lamp vessel is fixed with its first neck-shaped portion 2 to a lamp cap 30 of insulating material, for example, synthetic resin. A possibility is to use the means disclosed in European patent reference 0 478 058 A, corresponding to U.S. Pat. No. 5,216,319, for this purpose. The lamp cap has a first contact member 35, connected to the first current supply conductor 4, and a second contact member 36. A connection conductor 7 extends alongside the lamp vessel 1' to the lamp cap 30 and is connected to the second current supply conductor 5 and the second contact member 36. The lamp vessel 1' has a substantially concentric tubular outer envelope 20 which is filled with air.

The connection conductor 7 extends outside the outer envelope 20, which is substantially cylindrical and has a narrowing portion 21 which encloses the light source 1.

The second current supply conductor 5 has an abutment 22 for the outer envelope outside the outer envelope 20, in FIG. 1 a metal sleeve which is passed over the conductor 5 and on which a welded joint with the connection conductor 7 is realised.

The conductor 7 in FIG. 1 is surrounded by an insulator body 8, for example of $Al_2O_3$ or steatite, laterally of the lamp vessel 1'. Aternatively, however, the conductor 7 may be coated with an insulator, for example with a layer of $ZrO_2$ or $Al_2O_3$, or be uncoated. The synthetic-resin lamp cap 30 has a cover 31 of insulating material, for example of ceramic material, which is provided with a rim 32. The cover is fastened by means of a local ultrasonic deformation of the lamp cap, i.e. of pins 37 at this cap. The outer envelope 20 is centered and held in position, on the one hand, by the lamp cap, i.e. by its cover, and, on the other hand, by the second current supply conductor 5 and the abutment 22, and is supported by the connection conductor 7. The lamp cap 30 has the first contact member 35 centrally positioned inside a rim 39, and at the outside of the rim the annular second contact member 36. The lamp cap has studs 38 which can cooperate with a connector so as to form a bayonet coupling therewith.

Figure 2:
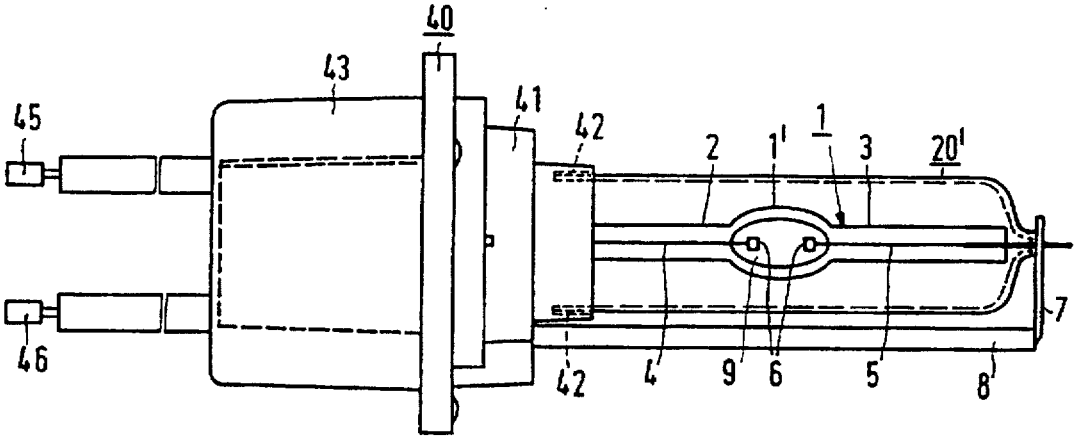
FIG. 2 shows a variation of FIG. 1 in side elevation.

In FIG. 2, identical parts have the same reference numerals as in FIG. 1. The outer envelope 20' surrounds the lamp vessel with greater clearance than in FIG. 1. The lamp cap 40 has a shell 43 from which cables issue to the exterior, comprising a first 45 and a second 46 contact member of the lamp cap. In a cover 41 of the lamp cap 40 facing the lamp vessel there is a groove 42 in which the outer envelope 20' is kept enclosed by the connection between the connection conductor 7 and the second current supply conductor 5.

In an embodiment, the lamp vessel contains an ionizable filling of mercury, rare gas, and metal halide, for example, mercury, sodium iodide and scandium iodide, and xenon, for example, xenon with a pressure of 7 bar at room temperature, while the lamp vessel has a greatest external diameter of 6 mm at the area of the discharge space. The lamp consumes a power of 35 W during operation. The lamp was provided with a quartz glass outer envelope chosen from a series with different internal diameters (I.D.) and with a wall thickness of 1 mm. The lamps of this embodiment were operated in horizontal position at rated power. The luminous flux (ϕ) and the highest temperature ($T_{MAX}$) of the lamp vessel were measured. A comparison was made with a similar lamp (Ex 0) without outer envelope. The results are listed in Table 1.

TABLE 1

| Ex | I.D. (mm) | 0.5 *(I.D. −6) (mm) | $T_{max}$ (°C.) | ϕ(lm) |
|---|---|---|---|---|
| 0 | — | — | 850 | 3000 |
| 1 | 22 | 8 | 870 | 3300 |
| 2 | 12 | 3 | 890 | 3400 |
| 3 | 8.7 | 1.35 | 870 | 3500 |
| 4 | 6.7 | 0.35 | 850 | 3300 |
| 5 | 6.1 | 0.05 | 820 | 3000 |

The Table shows that the highest temperature, in a horizontal operating position, the temperature above the imaginary line interconnecting the electrodes, and the luminous flux are dependent on the clearance, 0.5*(I.D.-6) which the lamp vessel has inside the outer envelope at the area of the discharge space.

The increase of the luminous flux in lamps Ex 1–4 as compared with Ex 0 points to a rise in the lowest temperature of the lamp vessel, at a place below the place of highest temperature, owing to which the vapour pressure in the lamp has become higher. The maximum temperature of the lamp vessel in lamps Ex 1 and 2 has risen only slightly in spite of the absence of provisions for rendering a convection flow through the outer envelope possible. This rise need not be a disadvantage in lamps with a medium life, for example, of a few thousands of hours.

The luminous flux increases still further (cf. Ex 2 and Ex 3) for lamps with a small clearance of approximately 2 mm or less, in particular 1.5 mm or less, while the maximum temperature becomes comparatively low. This points to a high degree of homogenization of the lamp vessel temperatures. The maximum temperature at the upper side of the lamp vessel comes comparatively close to the temperature at the lower side of the lamp vessel. The luminous flux is approximately 17% higher than without an outer envelope, while the lamp vessel is thermally hardly more heavily loaded. A considerable increase in the luminous flux at a substantially unchanged maximum temperature is obtained with a clearance of a few tenths of mm (Ex 4). With an extremely small clearance of approximately 0.1 mm or less (Ex 5), an unchanged luminous flux at a lower temperature than for Ex 0 is realised. This may be useful in a lamp which must have a comparatively long life. The temperature in this lamp has been homogenized, as is apparent from the lower $T_{max}$ and the identical luminous flux, while the cooling effect is enhanced.

Figure 3:
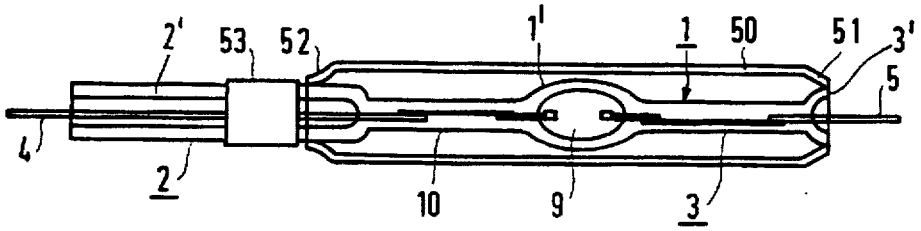
FIG. 3 is a side elevation of a second embodiment of the light source with its outer envelope.

In FIG. 3, the light source 1 has the same reference numerals as in the preceding Figures. The substantially cylindrical outer envelope 50 is coupled to neck-shaped portions 2, 3 of the lamp vessel 1' by its narrowing portions 52, 51, respectively, which have to bridge a small distance to the neck shaped portions only. In the Figure, the outer envelope 50 is not only coupled directly to an open substantially cylindrical tubular portion 2' of the first neck-shaped portion 2 by a narrowing portion 52, but also directly to the second neck-shaped portion 3 by a narrowing portion 51. A seal 10 is present in the neck-shaped potion 2. The second neck-shaped portion 3 is substantially entirely occupied by a similar seal and has a small tubular portion 3', only. Next to the seal 10, the first neck-shaped portion 2 has an open substantially cylindrical tubular potion on which a metal sleeve 53 is fixed on which the fastening to a lamp cap can be realised. If this sleeve were of different dimensions, however, it could have gripped around the outer envelope 50, or a tubular extension thereof, extending beyond the narrowing portion 52.

The space inside the outer envelope 50 is filled with air at atmospheric pressure when the couplings are not vacuum tight, or at room temperature at a pressure below atmospheric pressure when both couplings are vacuum tight. By the heat absorbed by the air during the heating of the glass required to achieve a coupling, the air has expanded. After the couplings have been achieved, the air has cooled down and assumes an underpressure.

We claim:

1. A capped electric lamp comprising:

a light source with a lamp vessel which is closed in a gastight manner and has an ionizable filling gas and with a first and a second mutually opposed neck-shaped portion, each neck-shaped portion having a seal, through which neck-shaped portions a first and a second current supply conductor, respectively, extend to a pair of electrodes arranged in the lamp vessel;

a lamp cap of insulating material to which the lamp vessel is fixed with the first neck-shaped portion, which lamp cap has a first contact member connected to the first current supply conductor, and a second contact member;

a connection conductor running alongside the lamp vessel to the lamp cap and being connected between the second current supply conductor and the second contact member;

the lamp vessel having a substantially concentric tubular outer envelope of quartz glass having low thermal expansion which is filled with air, characterized in that the connection conductor extends outside the outer envelope and the outer envelope is substantially cylindrical and has at least one narrowing portion which encloses the light source, said connection conductor being fixed to said second current supply conductor.

2. A capped high-pressure discharge lamp as claimed in claim 1, characterized in that the narrowing portion encloses the second current supply conductor.

3. A capped high-pressure discharge lamp as claimed in claim 2, characterized in that the second current supply conductor includes an abutment outside the outer envelope for fixing the end of the outer envelope.

4. A capped high-pressure discharge lamp as claimed in claim 1, characterized in that the outer envelope is coupled by the narrowing portion to at least one of said first and said second neck-shaped portion of the lamp vessel.

5. A capped high-pressure discharge lamp as claimed in claim 4, characterized in that the outer envelope is coupled to the first neck-shaped portion.

6. A capped high-pressure discharge lamp as claimed in claim 4, characterized in that the outer envelope is coupled to both neck-shaped portions by respective narrowing portions.

7. A capped high-pressure discharge lamp as claimed in claim 6, characterized in that the outer envelope is coupled to an open substantially cylindrical tubular portion of at least one of said first and said second neck-shaped portion.

8. A capped high-pressure discharge lamp as claimed in claim 7, characterized in that the outer envelope encloses the lamp vessel at the area of the discharge space with a clearance of less than 2 mm.

9. A capped high-pressure discharge lamp as claimed in claim 5, characterized in that the outer envelope is coupled to an open substantially cylindrical tubular portion of at least one of said first and said second neck-shaped portion.

10. A capped high-pressure discharge lamp as claimed in claim 9, characterized in that the outer envelope encloses the lamp vessel at the area of the discharge space with a clearance of less than 2 mm.

11. A capped high-pressure discharge lamp as claimed in claim 4, characterized in that the outer envelope is coupled to an open substantially cylindrical tubular portion of at least one of said first and said second neck-shaped portion.

12. A capped high-pressure discharge lamp as claimed in claim 4, characterized in that the outer envelope encloses the lamp vessel at the area of the discharge space with a clearance of less than 2 mm.

13. A capped high-pressure discharge lamp as claimed in claim 1, characterized in that the outer envelope encloses the lamp vessel at the area of the discharge space with a clearance of less than 2 mm.

* * * * *